US010923046B2

(12) United States Patent
Sun et al.

(10) Patent No.: US 10,923,046 B2
(45) Date of Patent: Feb. 16, 2021

(54) IMAGE DISPLAY PROCESSING METHOD AND DEVICE, DISPLAY DEVICE AND NON-VOLATILE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yilang Sun, Beijing (CN); Tiankuo Shi, Beijing (CN); Xiaomang Zhang, Beijing (CN); Zhihua Ji, Beijing (CN); Yifang Chu, Beijing (CN); Lingyun Shi, Beijing (CN); Yifan Hou, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/392,044

(22) Filed: Apr. 23, 2019

(65) Prior Publication Data

US 2020/0082769 A1 Mar. 12, 2020

(30) Foreign Application Priority Data

Sep. 7, 2018 (CN) ..... 2018 1 1045347

(51) Int. Cl.
*G09G 3/34* (2006.01)
*G09G 3/36* (2006.01)

(52) U.S. Cl.
CPC ..... *G09G 3/342* (2013.01); *G09G 3/3607* (2013.01); *G09G 2320/0686* (2013.01); *G09G 2360/16* (2013.01)

(58) Field of Classification Search
CPC ..... G09G 3/342; G09G 3/3607; G09G 2320/0686; G09G 2360/16
See application file for complete search history.

(56) References Cited

U.S. PATENT DOCUMENTS

2010/0328336 A1 12/2010 Si
2011/0267379 A1 11/2011 Kurabayashi et al.
(Continued)

FOREIGN PATENT DOCUMENTS

CN 101599258 A 12/2009
CN 102237064 A 11/2011
(Continued)

OTHER PUBLICATIONS

First Chinese Office Action dated Jan. 20, 2020.
(Continued)

*Primary Examiner* — Alexander Eisen
*Assistant Examiner* — Nathaniel P Brittingham
(74) *Attorney, Agent, or Firm* — Dilworth & Barrese, LLP.; Michael J. Musella, Esq.

(57) ABSTRACT

An image display processing method for a display device, an image display processing device, a display device, and a non-volatile storage medium are provided. The display device includes a backlight unit, and the backlight unit is divided into a plurality of display backlight blocks and driven by a local dimming mode. The image display processing method includes: determining at least one boundary backlight block corresponding to a display image in the plurality of display backlight blocks; determining at least one target pixel and at least one background pixel corresponding to each boundary backlight block, and obtaining a backlight value of each boundary backlight block based on
(Continued)

a grayscale value of the at least one target pixel and a grayscale value of the at least one background pixel; and displaying the display image.

17 Claims, 8 Drawing Sheets

(56) References Cited

U.S. PATENT DOCUMENTS

| | | | | |
|---|---|---|---|---|
| 2013/0265337 | A1 | 10/2013 | Furumoto et al. | |
| 2014/0368420 | A1 | 12/2014 | Nishio | |
| 2017/0154584 | A1* | 6/2017 | Lin | G09G 3/2003 |
| 2018/0182356 | A1* | 6/2018 | Seong | G09G 5/10 |

FOREIGN PATENT DOCUMENTS

| | | | |
|---|---|---|---|
| CN | 105047140 | A | 11/2015 |
| CN | 108470548 | A | 8/2018 |
| EP | 2015134 | A2 | 1/2009 |

OTHER PUBLICATIONS

NPL-1-Image-classification-based global dimming algorithm for LED backlights in LCDs ( By He Huijie, Hefei University of Technology , the English Abstract is in the p. 9 of the document.
NPL-2-Dynamic LED Backlight Dimming Technology and Application in LCD TVs (By Han Dong, Hefei University of Technology , the English Abstract is in the p. 9 of the document.

* cited by examiner

IMAGE DISPLAY PROCESSING METHOD AND DEVICE, DISPLAY DEVICE AND NON-VOLATILE STORAGE MEDIUM

The present application claims priority of Chinese Patent Application No. 201811045347.2, filed on Sep. 7, 2018, the disclosure of which is incorporated herein by reference in its entirety as part of the present application.

TECHNICAL FIELD

Embodiments of the present disclosure relate to an image display processing method for a display device, an image display processing device, a display device and a non-volatile storage medium.

BACKGROUND

Local Dimming technologies can divide a backlight unit into a plurality of backlight blocks which can be driven individually, and each of the plurality of backlight blocks includes one or more light-emitting diodes (LEDs). According to grayscales that need to be displayed in various parts of display screen, the driving currents of the LEDs of backlight blocks corresponding to these parts can be automatically adjusted, to achieve an independent adjustment to the brightness of each of the plurality of backlight blocks in the backlight unit, so a contrast of the display screen can be improved.

SUMMARY

At least one embodiment of the present disclosure provides an image display processing method for a display device, the display device includes a backlight unit, the backlight unit is divided into a plurality of display backlight blocks and driven by a local dimming mode, and the image display processing method includes: determining at least one boundary backlight block corresponding to a display image in the plurality of display backlight blocks; determining at least one target pixel and at least one background pixel corresponding to each boundary backlight block, and obtaining a backlight value of each boundary backlight block based on a grayscale value of the at least one target pixel and a grayscale value of the at least one background pixel; and displaying the display image based on the backlight value of each boundary backlight block corresponding to the display image and a backlight value of at least one non-boundary backlight block other than the at least one boundary backlight block in the plurality of display backlight blocks.

For example, in the image display processing method provided by some embodiments of the present disclosure, the backlight value of each boundary backlight block is expressed as:

$$G=G1*K+(1-K)*G2$$

where G represents the backlight value of each boundary backlight block, G1 represents an average grayscale of the at least one target pixel corresponding to each boundary backlight block, G2 represents an average grayscale of the at least one background pixel corresponding to each boundary backlight block, and K represents a ratio of a number of target pixels corresponding to each boundary backlight block to a total number of display pixels corresponding to each boundary backlight block.

For example, in the image display processing method provided by some embodiments of the present disclosure, the average grayscale of the at least one target pixel corresponding to each boundary backlight block is expressed as:

$$G1=\frac{\sum_{i=1}^{N} L_i}{N}$$

where Li represents a grayscale value of an i-th target pixel, $1 \le i \le N$, N is an integer greater than 1, and N represents the number of the target pixels corresponding to each boundary backlight block.

For example, in the image display processing method provided by some embodiments of the present disclosure, the average grayscale of the at least one background pixel corresponding to each boundary backlight block is expressed as:

$$G2=\frac{\sum_{j=1}^{M} L_j}{M}$$

where Lj represents a grayscale value of a j-th background pixel, $1 \le j \le M$, M is an integer greater than 1, and M represents a number of background pixels corresponding to each boundary backlight block.

For example, in the image display processing method provided by some embodiments of the present disclosure, determining the at least one boundary backlight block corresponding to the display image in the plurality of display backlight blocks includes: setting a preset threshold; obtaining a ratio of a number of target pixels corresponding to each of the plurality of display backlight blocks corresponding to the display image to a total number of display pixels corresponding to each of the plurality of display backlight blocks respectively; judging whether the ratio of the number of the target pixels corresponding to each of the plurality of display backlight blocks to the total number of the display pixels corresponding to each of the plurality of display backlight blocks is less than or equal to the preset threshold respectively; and taking a display backlight block having a ratio less than or equal to the preset threshold as the boundary backlight block.

For example, in the image display processing method provided by some embodiments of the present disclosure, determining the at least one boundary backlight block corresponding to the display image in the plurality of display backlight blocks includes: obtaining a pattern analysis result of the display image, with the pattern analysis result recording a boundary pixel; and taking a display backlight block corresponding to the boundary pixel as the boundary backlight block.

For example, the image display processing method provided by some embodiments of the present disclosure further includes: selecting a block grayscale threshold of all display pixels corresponding to each of the plurality of display backlight blocks; taking a display pixel, a grayscale value of which is less than the block grayscale threshold, as the background pixel; and taking a display pixel, a grayscale value of which is greater than or equal to the block grayscale threshold, as the target pixel.

For example, in the image display processing method provided by some embodiments of the present disclosure, the backlight unit includes a plurality of basic backlight blocks, and the image display processing method further includes: selecting a backlight block mode of the backlight unit, and dividing the plurality of basic backlight blocks into the plurality of display backlight blocks based on the backlight block mode.

For example, in the image display processing method provided by some embodiments of the present disclosure, the backlight block mode of the backlight unit is determined based on power consumption of the backlight unit and/or a display effect of the display image.

For example, the image display processing method provided by some embodiments of the present disclosure further includes: after acquiring the backlight value of each boundary backlight block, performing a process of smooth filtering on the plurality of display backlight blocks to adjust the backlight value of each boundary backlight blocks.

For example, in the image display processing method provided by some embodiments of the present disclosure, the backlight value of each non-boundary backlight block is a maximum value of grayscale values of all display pixels corresponding to each non-boundary backlight block.

At least one embodiment of the present disclosure further provides an image display processing device, which includes: a boundary backlight block determining circuit, configured to determine at least one boundary backlight block corresponding to a display image in a plurality of display backlight blocks; a backlight value acquisition circuit, configured to determine at least one target pixel and at least one background pixel respectively corresponding to each boundary backlight block, and obtain a backlight value of each boundary backlight block based on a grayscale value of the at least one target pixel and a grayscale value of the at least one background pixel; and an image display circuit, configured to display the display image based on the backlight value of each boundary backlight block corresponding to the display image and a backlight value of at least one non-boundary backlight block other than the at least one boundary backlight block of the plurality in display backlight blocks.

For example, in the image display processing device provided by some embodiments of the present disclosure, the backlight value of each boundary backlight block is expressed as:

$$G=G1*K+(1-K)*G2$$

where G represents the backlight value of each boundary backlight block, G1 represents an average grayscale of the at least one target pixel corresponding to each boundary backlight block, G2 represents an average grayscale of the at least one background pixel corresponding to each boundary backlight block, and K represents a ratio of a number of target pixels corresponding to each boundary backlight block to a total number of display pixels corresponding to each boundary backlight block.

For example, in the image display processing device provided by some embodiments of the present disclosure, the average grayscale of the at least one target pixel corresponding to each boundary backlight block is expressed as:

$$G1 = \frac{\sum_{i=1}^{N} L_i}{N}$$

where $L_i$ represents a grayscale value of an i-th target pixel, $1 \le i \le N$, N is an integer greater than 1, and N represents the number of the target pixels corresponding to each boundary backlight block.

For example, in the image display processing device provided by some embodiments of the present disclosure, the average grayscale of the at least one background pixel corresponding to each boundary backlight block is expressed as:

$$G2 = \frac{\sum_{j=1}^{M} L_j}{M}$$

where $L_j$ represents a grayscale value of a j-th background pixel, $1 \le j \le M$, M is an integer greater than 1, and M represents the number of background pixels corresponding to each boundary backlight block.

At least one embodiment of the present disclosure also provides an image display processing device, which includes a processor; a storage; and one or a plurality of computer program modules. The one or the plurality of computer program modules are stored in the storage and are configured to be executed by the processor, and the one or the plurality of computer program modules include an instruction used for achieving the image display processing method provided by any one of the embodiments of the present disclosure.

At least one embodiment of the present disclosure also provides a display device, which includes a backlight unit and the image display processing device provided by any one of the embodiments of the present disclosure.

At least one embodiment of the present disclosure also provides a non-volatile storage medium, which stores a computer-readable instruction non-transitorily, and executes an instruction of the image display processing method provided by any one of the embodiments of the present disclosure in a case where the computer-readable instruction stored non-transitorily is executed by a computer.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
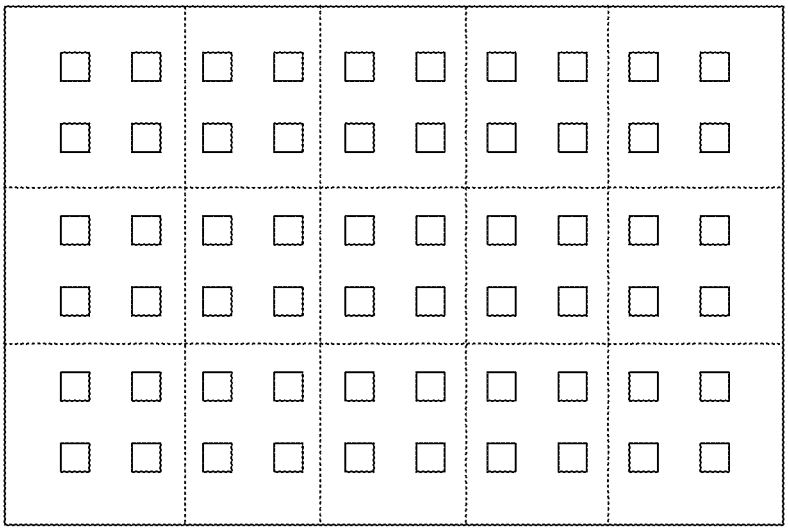
FIG. 1A is a schematic diagram of a backlight unit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

The present disclosure is described below with reference to a plurality of specific embodiments. In order to keep the following description of the embodiments of the present disclosure clear and concise, detailed descriptions of known functions and known components can be omitted. In a case where any component according to an embodiment of the present disclosure appears in more than one drawings, the component is denoted by a same reference numerals in each drawing.

A liquid crystal display (LCD) includes a liquid crystal panel and a backlight unit. Generally, a liquid crystal panel includes an array substrate and an opposite substrate (for example, a color filter substrate) disposed opposite to each other to form a liquid crystal cell, and a liquid crystal layer is filled between the array substrate and the opposite substrate in the liquid crystal cell. A first polarizer is on the array substrate, and a second polarizer is on the opposite substrate, and a polarization direction of the first polarizer is perpendicular to a polarization direction of the second polarizer, for example. The backlight unit is on a non-display side of the liquid crystal panel for providing a planar light source for the liquid crystal panel. Liquid crystal molecules of the liquid crystal layer are twisted by a driving electric field formed between a pixel electrode on the array substrate and a common electrode on the array substrate or a common electrode on the opposite substrate, so as to control a polarization direction of light passing through the liquid crystal molecules, and transmittance of the light is controlled by the cooperation of the first polarizer and the second polarizer, thereby realizing grayscale display. The backlight unit may be a direct-lit backlight unit or a side-lit backlight unit. A direct-lit backlight unit includes a plurality of point light sources (for example, LEDs) arranged side by side and a diffusion plate. Light emitted by the point light sources is homogenized by the diffusion plate, and then incident on the liquid crystal panel for display.

Local dimming technologies are generally only applicable to the direct-lit backlight unit, and a plurality of LEDs as the light sources are evenly distributed over an entire backplane, for example. For example, in an exemplary direct-lit backlight unit, a schematic diagram of dividing regions of the LED light sources in the entire backplane is shown in FIG 1A. A small square as shown in FIG. 1A represents an LED unit, and a plurality of regions separated by broken lines represent a plurality of backlight regions (i.e., backlight blocks). Each of the plurality of backlight regions includes one or more LED units and can be controlled independently of other backlight regions. For example, the LEDs in each of the plurality of backlight block are linked, for example, connected in series, that is, currents passing through the LEDs in a same backlight block are consistent.

The local dimming technologies can adjust the brightness of the corresponding backlight block as shown in FIG. 1A according to the grayscales of screen content (i.e., image) to be displayed by the liquid crystal display panel. For example, for a portion with a higher brightness (grayscale) of the screen in display, the brightness of the backlight block corresponding to the portion is also high, and for a portion with a lower brightness of the screen in display, the brightness of the backlight block corresponding to the portion is also low, so backlight power consumption can be reduced, a contrast of the display screen can be improved, and a display quality can be enhanced.

Figure 1B:
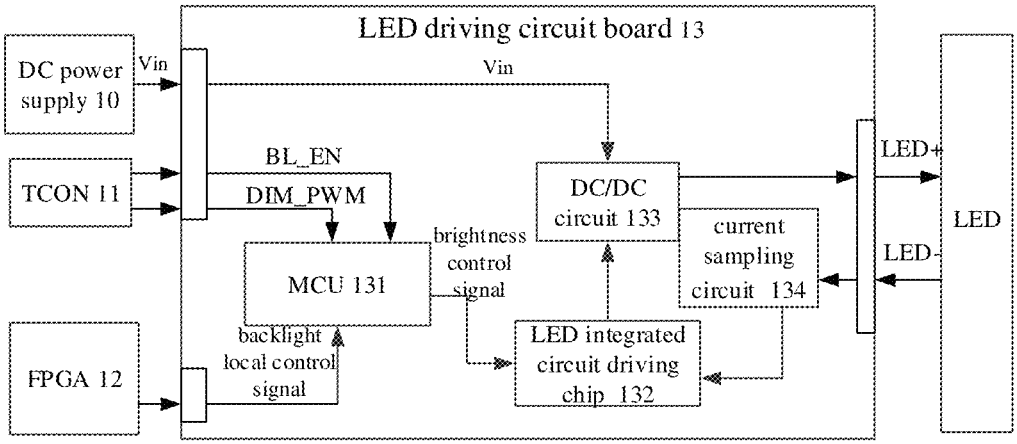
FIG. 1B is a schematic diagram of an exemplary system of performing local dimming processing on the backlight unit as shown in FIG. 1A.

FIG. 1B is a schematic diagram of an exemplary system for performing local dimming processing on the backlight unit as shown in FIG. 1A. For example, in some examples, the system is implemented by hardware circuitry. As shown in FIG. 1B, the system includes, for example, a DC power supply 10, a TCON (Timer Control Register) 11, an FPGA (Field-Programmable Gate Array) 12, and an LED driving circuit board 13 for driving the LEDs to emit light. As shown in FIG. 1B, the LED driving circuit board 13 includes a micro-chip unit (MCU) 131, an LED integrated circuit driving chip 132, a DC/DC circuit 133, and a current sampling circuit 134. The LED driving circuit board 13 is configured to process each frame image signal to obtain processed backlight brightness data of each of the plurality of backlight blocks, and generate driving voltages used for various backlight regions based on the backlight brightness data. The driving voltages are output to the corresponding backlight bocks to drive the LEDs in the backlight blocks to emit light.

The MCU 131 receives a backlight local control signal (Local Dimming SPI (Serial Peripheral Interface) signal) from the FPGA 12, a SOC (System on Chip, not as shown in FIG. 1B), or the TCON 11, and the backlight local control signal is used in an "AND" operation (controlling whether the "AND" operation is performed according to an enable signal (BL_EN)) with a brightness modulation signal (DIM_PWM) from the TCON 11 to obtain a brightness control signal of each of the plurality of backlight blocks. Then, the MCU 131 outputs the brightness control signal to the LED integrated circuit driving chip 132 to implement current control of the LEDs of each of the plurality of backlight blocks, thereby controlling the luminance of each of the plurality of backlight blocks.

For example, the system for performing the local dimming processing is powered by an external DC power source 10, and the supply voltage Vin of the power source 10 is typically 24 voltages (V). For example, the DC/DC circuit 133 can employ a voltage conversion circuit (e.g., a Boost circuit) to boost the supply voltage Vin to a driving voltage required by illuminating the LEDs of each of the plurality of backlight blocks, and inputs the driving voltage to each backlight block under the control of the brightness control signal output by the LED integrated circuit driving chip to drive each of the plurality of backlight blocks to emit light.

Because even a small fluctuation of a working voltage applied to the LEDs may cause a large change of the current flowing though the LEDs, the LEDs in the system can be dimmed by a constant-current control mode. To achieve the constant-current control, cathode electrodes (LED-) of the plurality of LEDs connected in series in each of the plurality of backlight blocks is connected to the current sampling circuit 134 to monitor the stability of the currents flowing though LEDs in real time. The current sampling circuit 134 converts the currents flowing through the LEDs into voltage signals and feeds the voltage signals back to the LED integrated circuit driving chip 132, and then the LED integrated circuit driving chip 132 feeds the voltage signals back to the DC/DC circuit 133. After receiving the voltage signals, the DC/DC circuit 133 adjusts an output voltage input to anode electrodes (LED+) of the LEDs to achieve a steady current action on the LEDs. For example, the converted voltage signals are sampled and the sampled voltage signals are compared to a preset reference voltage. In a case where the sampled voltage signals is higher than the reference voltage, the current sampling circuit 134 outputs a control signal to enable the DC/DC circuit 133 to reduce the output voltage, thereby reducing the currents flowing through the LEDs; otherwise, the current sampling circuit 134 outputs another control signal to enable the DC/DC circuit 133 to boost the output voltage to increase the currents flowing through the LEDs. That is, the current sampling circuit 134 can be used as a negative feedback circuit to realize the constant-current control to the LEDs to enable the LEDs to work stably.

Figure 1C:
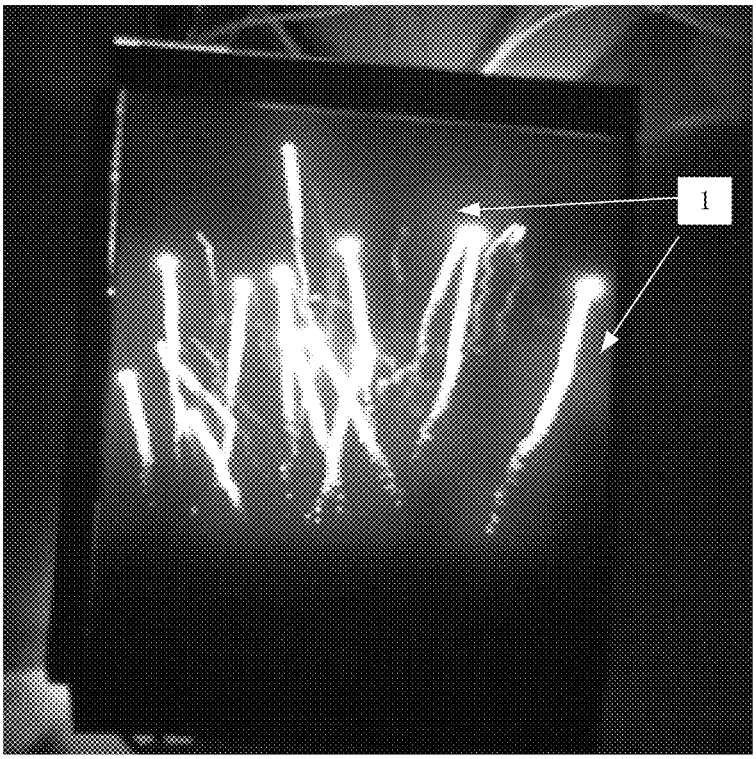
FIG. 1C is a schematic diagram of a halo phenomenon generated in a case where local dimming processing is performed on the backlight unit as shown in FIG. 1A.
Figure 1D:
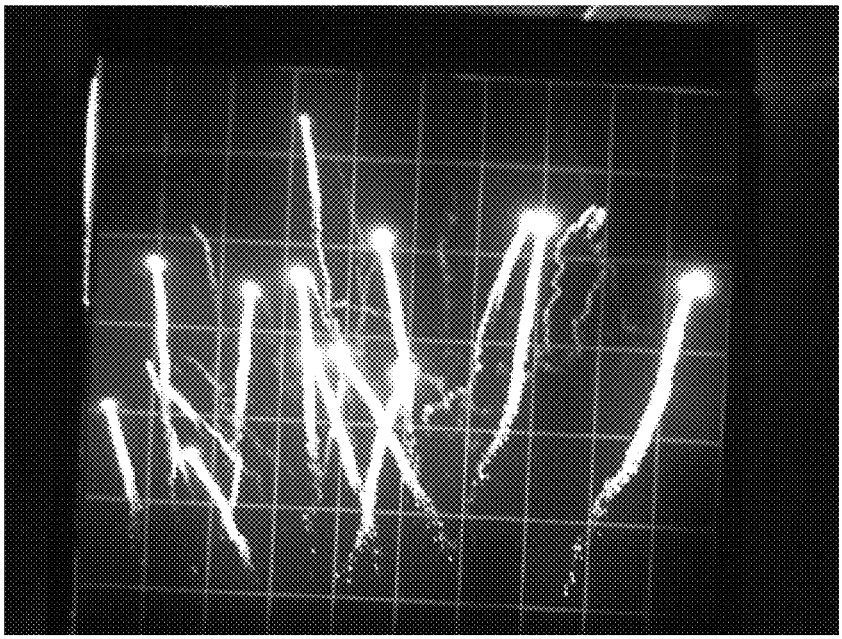
FIG. 1D is a schematic diagram of a halo diffusion phenomenon of a display panel corresponding to each backlight block of the backlight unit as shown in FIG. 1A.

FIG. 1C is a schematic diagram of a halo phenomenon generated in a case where the local dimming processing is performed on the backlight unit as shown in FIG. 1A. As can be seen from FIG. 1C, when pixels in the display panel are driven by the local dimming technology to display a picture having a background which is a dark background, the range of the halo appears around a target pixel (e.g., firework) (for example, region 1 as indicated by an arrow as shown in FIG. 1C), and the halo severely affects the display effect. In order to determine the diffusion range of the halo, as shown in FIG. 1D, each of the plurality of backlight blocks of the backlight unit is marked on the displayed image of the LCD, so the displayed image of the LCD can be divided into a plurality of regions corresponding to the plurality of backlight blocks of the backlight unit in one-to-one correspondence. As can be seen from FIG. 1D, after the backlight blocks are marked on the displayed image of the LCD, the diffusion range of the halo becomes clearly visible. That is, in a case where a portion of the display image corresponding to a backlight block includes both a target content (i.e., a target display picture) and a background content (e.g., a non-target display picture), the display region corresponding to the background content generates a halo, so the display quality of the display panel is seriously affected.

At least one embodiment of the present disclosure provides an image display processing method for a display device, the display device includes a backlight unit, the backlight unit can be divided into a plurality of display backlight blocks and driven by a local dimming mode, and the image display processing method includes: determining at least one boundary backlight block corresponding to a display image in the plurality of display backlight blocks; determining at least one target pixel and at least one background pixel corresponding to each boundary backlight block, and obtaining a backlight value of each boundary backlight block based on a grayscale value of the at least one target pixel and a grayscale value of the at least one background pixel; and displaying the display image based on the backlight value of each boundary backlight block corresponding to the display image and a backlight value of at least one non-boundary backlight block other than the at least one boundary backlight block in the plurality of display backlight blocks.

At least one embodiment of the present disclosure also provides an image display processing device, a display device, and a storage medium corresponding to the image display processing method described above.

The image display processing method provided by the above embodiment of the present disclosure reduces the backlight value of the boundary backlight block according to a certain proportion to achieve the effect of weakening the halo, so the problem of the halo generated in the display image displayed on the display panel in performing the local dimming technology to drive the backlight block can be solved, and the display quality of the display panel can be improved.

Embodiments and some examples of the present disclosure will be described in detail below with reference to the accompanying drawings.

Figure 2A:
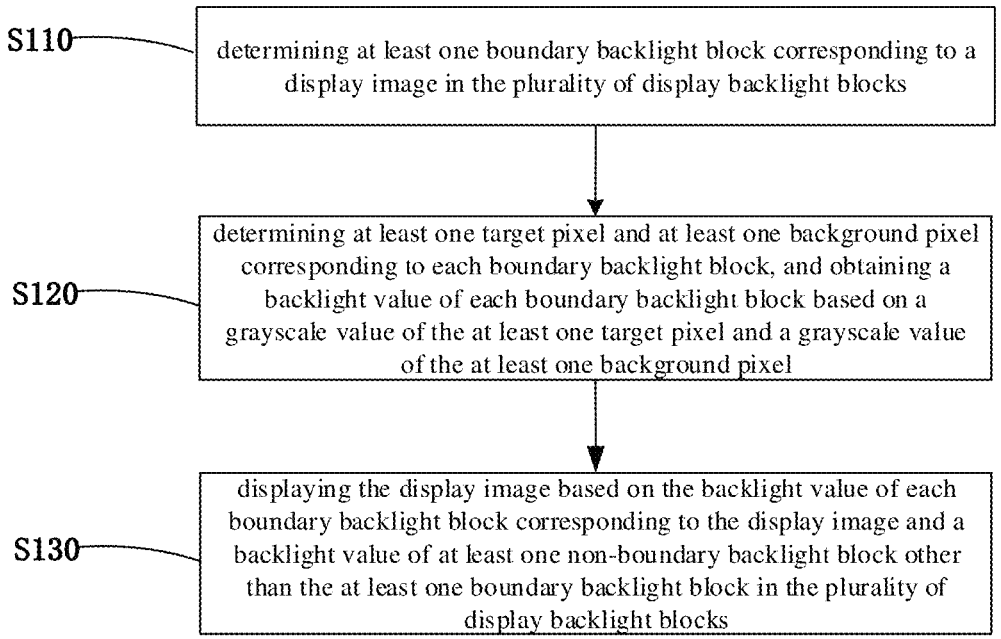
FIG. 2A is a flowchart of an image display processing method according to at least an embodiment of the present disclosure.

FIG. 2A is a flowchart of an image display processing method for a display device according to at least an embodiment of the present disclosure. For example, the display device includes a backlight unit, and the backlight unit are divided into a plurality of display backlight blocks and driven by a local dimming mode. For example, the display backlight blocks of the backlight unit may be set in a manner as shown in FIG. 1A, or may be set in other manners, the embodiments of the present disclosure are not limited to this case. For example, the display device is an LCD display device or an electronic paper display device, etc., and the LCD display device may be described below as an example. For example, at least a part of the image display processing method can be implemented in software, and loaded and executed by a processor in a display panel, or at least a part of the image display processing method can be implemented in hardware or firmware, to weaken the halo generated by the display device in a case where the local dimming technology is performed to drive the backlight blocks.

For example, the LCD display device may further include a pixel array, a data decoding circuit, a timing controller (T-con), a gate driving circuit, a data driving circuit, a storage device (for example, a flash memory or the like), and the like. The data decoding circuit receives a display input signal and decodes the display input signal to obtain a display data signal; and the timing controller outputs timing signals to control the gate driving circuit, the data driving circuit, etc., to enable the circuits to work synchronously, and can perform gamma correction on the display data signal. The processed display data signal is input to the data driving circuit to perform a display operation. These components can be used in a conventional manner and will not be described here again.

Next, an image display processing method for a display device according to an embodiment of the present disclosure will be described with reference to FIG. 2A. As shown in FIG. 2A, the image display processing method includes steps S110 to S130. Firstly, at least one boundary backlight block corresponding to the display image, and at least one target pixel and at least one background pixel that are corresponding to each boundary backlight block are determined; then, for each boundary backlight block, a backlight value of each boundary backlight block is adjusted based on a grayscale value of the at least one target pixel and a grayscale value of the at least one background pixel to weaken the halo generated by the display device in a case where the local dimming technology is performed to drive the backlight blocks. The steps S110 to S130 of the image display processing method and respective exemplary implementations of the Steps S110 to S130 are respectively described below.

Step S110: determining at least one boundary backlight block corresponding to a display image in the plurality of display backlight blocks.

Step S120: determining at least one target pixel and at least one background pixel corresponding to each boundary backlight block, and obtaining a backlight value of each boundary backlight block based on a grayscale value of the at least one target pixel and a grayscale value of the at least one background pixel.

Step S130: displaying the display image based on the backlight value of each boundary backlight block corresponding to the display image and a backlight value of at least one non-boundary backlight block other than the at least one boundary backlight block in the plurality of display backlight blocks.

For example, in the embodiments of the present disclosure, "corresponding" means that the backlight block overlaps with the pixel or the display panel, where the pixel is located, in an orthographic projection direction of the display panel (e.g., the direct front direction of the display panel), and the following embodiments are the same as this case described here, and are not described again.

In the embodiments of the present disclosure, "determining at least one target pixel and at least one background pixel respectively corresponding to each boundary backlight block" represents dividing pixels corresponding to each boundary backlight block into the target pixel and the background pixel.

It should be noted that, in the embodiments of the present disclosure, "at least one" may also include one or "a plurality", and the following "a plurality" is taken as an example to describe. The following embodiments are the same as this case, and are not described again.

Figure 2B:
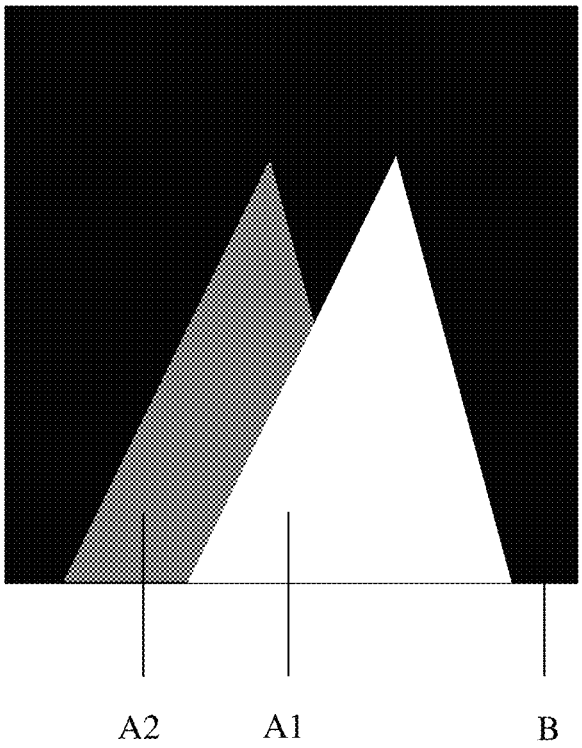
FIG. 2B is a schematic diagram of at least one target pixel and at least one background pixel corresponding to each backlight block according to at least an embodiment of the present disclosure.

FIG. 2B is a schematic diagram of at least one target pixel and at least one background pixel corresponding to a backlight block according to at least an embodiment of the present disclosure. As shown in FIG. 2B, A1 and A2 represent target pixel regions with different grayscales, respectively, and B represents a background pixel region.

Figure 3:
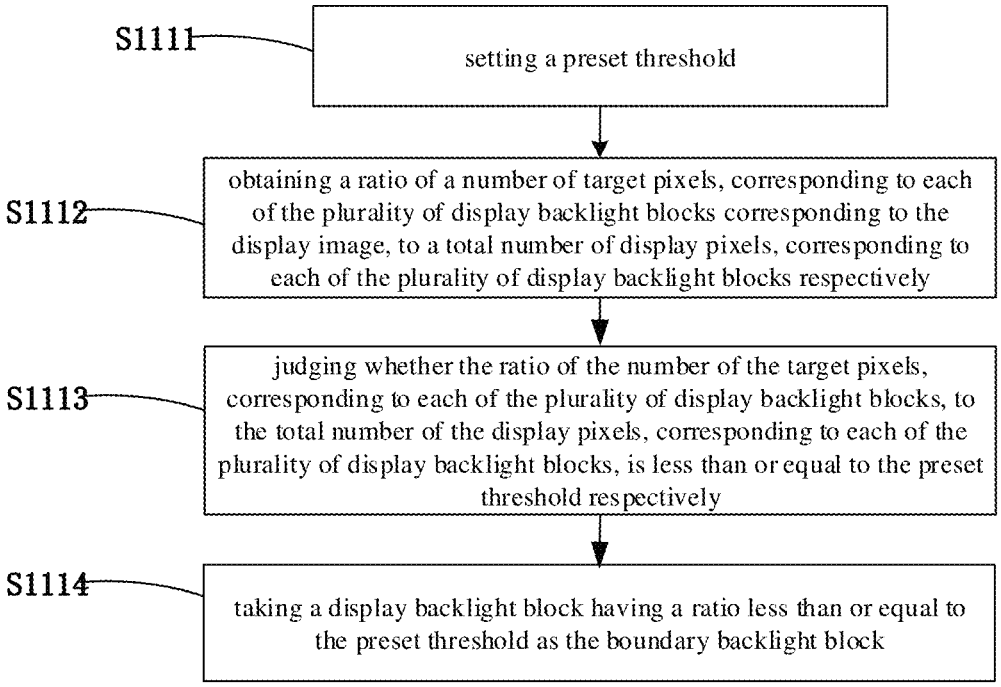
FIG. 3 is a flow chart of some examples of a method of determining a boundary backlight block.

For example, in the present embodiment, the target pixel represents a pixel that displays a target picture (e.g., an object) in the display image, and the background pixel represents a pixel that does not display the target picture of the display image. For example, the target picture may include a foreground picture such as a firework as shown in FIG. 1C, a rose as shown in FIG. 4B, and the like. In addition, a backlight block that drives both the target pixel and the background pixel is recorded as the boundary backlight block, and the halo is typically generated in the boundary backlight block. A backlight block except the boundary backlight block is the non-boundary backlight block. The method of determining the boundary backlight block may be described in detail in connection with FIG. 3 and FIG. 4A, and details are not described here again.

Because the halo is typically generated within the boundary backlight block, in the step S110, a plurality of boundary backlight blocks corresponding to the display image are first determined in the plurality of display backlight blocks. FIG. 3 is a flow chart of some examples of determining a boundary backlight block. That is, FIG. 3 is a flowchart of one example of the step S110 as shown in FIG. 2A. As shown in FIG. 3, the method of determining the boundary backlight block in the image display processing method includes steps S1111 to S1114.

Step S1111: setting a preset threshold.

The preset threshold is used to classify the boundary background block(s) and the non-boundary background block(s). A specific division method may be described in detail in the following steps. For example, the preset threshold may be a value between 0.85-1.00. The preset threshold may be determined according to specific circumstances, and the embodiments of the present disclosure are not limited to this case.

Step S1112: obtaining a ratio of a number of target pixels, corresponding to each of the plurality of display backlight blocks corresponding to the display image, to a total number of display pixels, corresponding to each of the plurality of display backlight blocks respectively.

Figure 5:
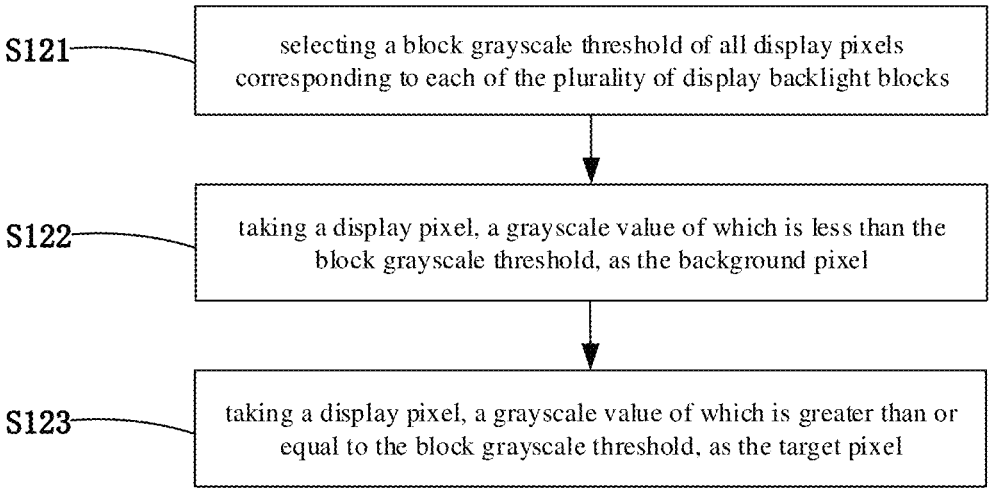
FIG. 5 is a flow chart of some examples of a method of determining at least one target pixel and at least one background pixel.

For example, firstly, the target pixels and the background pixels corresponding to each of the plurality of display backlight blocks are respectively determined. The specific determination method may be described in detail below (as shown in FIG. 5), and details are not described here again. Then, the number A of the target pixels and the number B of all the display pixels (including the target pixels and the background pixels) corresponding to each of the plurality of display backlight blocks are separately counted. Finally, the ratio T of the number A of the target pixels and the total number B of the display pixels corresponding to each of the plurality of display backlight blocks is obtained. For example, the ratio T can be expressed as:

$$T=A/B$$

where A represents the number of the target pixels and B represents the total number of the display pixels.

Step S1113: judging whether the ratio of the number of the target pixels corresponding to each of the plurality of display backlight blocks to the total number of the display pixels corresponding to each of the plurality of display backlight blocks is less than or equal to the preset threshold respectively.

For example, the ratio T of each of the plurality of display backlight blocks obtained in the step S1112 is compared with the preset threshold set in the step S1111. If a ratio T of a display backlight block is less than (or equal to) the preset threshold, this display backlight block is used as the boundary backlight block, and the backlight value is adjusted. The specific adjustment method may be described in detail in the following steps. If a ratio T of a display backlight block is greater than the preset threshold, this display backlight block is regarded as a non-boundary backlight block, and the display pixels corresponding to the non-boundary backlight block are regarded as target pixels, that is, the display pixel does not include the background pixel, and the backlight value of the display backlight block is also not adjusted.

Step S1114: taking a display backlight block having a ratio less than or equal to the preset threshold as the boundary backlight block.

Figure 4A:
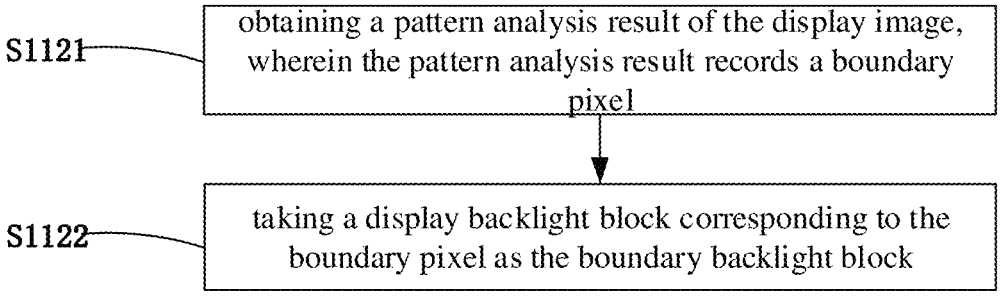
FIG. 4A is a flowchart of other some examples of a method of determining a boundary backlight block.
Figure 4B:
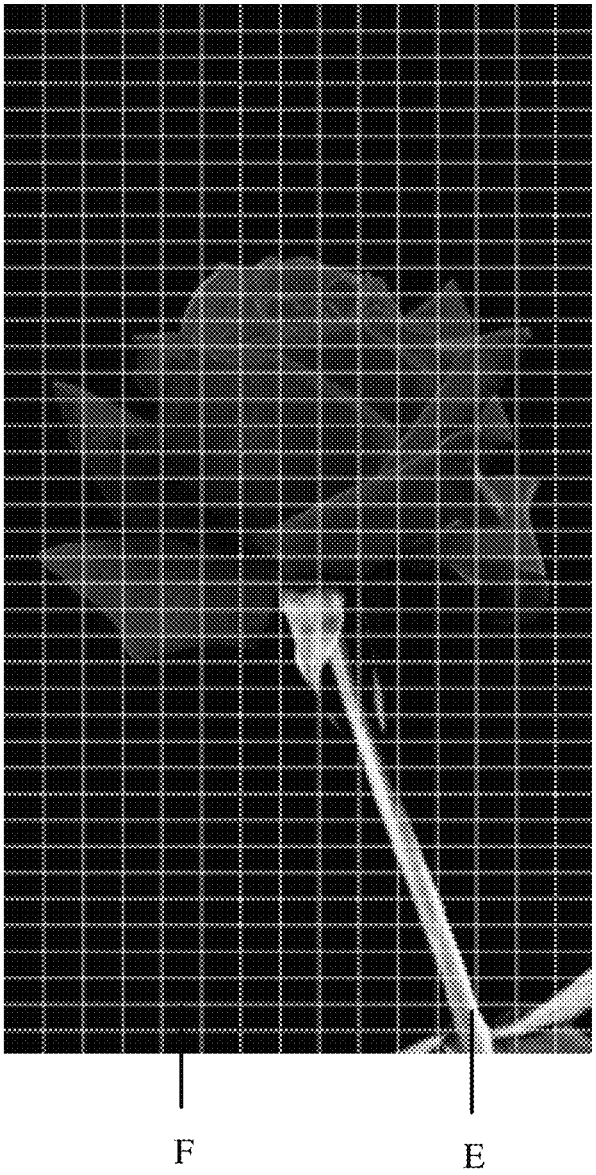
FIG. 4B is a schematic diagram of a display image according to at least an embodiment of the present disclosure.

FIG. 4A is a flow chart of other some examples of determining a boundary backlight block. That is, FIG. 4A is a flowchart of other some examples of the step S110 as shown in FIG. 2A. As shown in FIG. 4A, the method of determining the boundary backlight block in the image display processing method includes steps S1121 to S1122.

Step S1121: obtaining a pattern analysis result of the display image with the pattern analysis result recording a boundary pixel.

FIG. 4B is a schematic diagram of a display image according to at least an embodiment of the present disclosure. As shown in FIG. 4B, the display image includes a target picture E (for example, the rose as shown in FIG. 4B) and a background picture F (for example, the dark (e.g., black) background region as shown in FIG. 4B). For example, an image analysis processing is performed on the display image as shown in FIG. 4B to obtain a pattern analysis result of the display image. For example, a histogram analysis method or other conventional image analysis algorithms in the art may be employed, and are not described here. For example, the position of the boundary pixel of the target picture (for example, the target picture E as shown in FIG. 4B) is recorded in the pattern analysis result.

Step S1122: taking a display backlight block corresponding to the boundary pixel as the boundary backlight block.

For example, the display backlight blocks corresponding to the display image are marked on the display image, and the pixels of the display image correspond to the display backlight blocks, so the display backlight block corresponding to the boundary pixel can be determined as the boundary backlight block.

For example, after the boundary backlight blocks is determined by the step S1122, the boundary backlight blocks may be further processed by the method of determining the boundary backlight blocks as shown in FIG. 3 (including the step S1111—the step S1114) to further reduce the range of the boundary backlight blocks, thus reducing the amount of calculations in subsequent steps.

For example, a boundary backlight block determining circuit may be set, and the boundary backlight block(s) is determined by the boundary backlight block determining circuit. For example, the boundary backlight block(s) may also be determined by a central processing unit (CPU), a graphics processor (GPU), a field programmable gate array (FPGA), or other processing units with a data processing capabilities and/or instruction execution capabilities. For example, the processing units may be a general purpose processor or a dedicated processor, and may be a processor based on X86 or ARM architecture, or the like.

In the step S120, for example, after determining the boundary backlight block, the target pixels and the background pixels corresponding to each boundary backlight block can be respectively determined, so the backlight value of each boundary backlight block is obtained based on the grayscale values of the target pixels and the grayscale values of the background pixels.

FIG. 5 is a flowchart of a method of determining at least one target pixel and at least one background pixel according to at least an embodiment of the present disclosure. That is, FIG. 5 is a flowchart of some examples of the step S120 as shown in FIG. 2A. As shown in FIG. 5, the method of determining the target pixels and the background pixels in the image display processing method includes steps S121 to S123.

Step S121: selecting a block grayscale threshold for all display pixels corresponding to each of the plurality of display backlight blocks.

For example, the block grayscale threshold is used to determine the target pixel and the background pixel. For example, in some examples, a display pixel having a grayscale value greater than (or equal to) the block grayscale threshold is taken as the target pixel, and a display pixel having a grayscale value less than the block grayscale threshold is taken as the background pixel.

For example, the histograms of grayscale values of all the display pixels (including the grayscale values of the target pixels and the grayscale values of the background pixels) corresponding to each of the plurality of display backlight blocks are counted. Because the grayscale values of the background pixels are substantially identical, the block grayscale threshold can be determined according to a statistical rule of the histograms of all the display backlight blocks. For example, the value with a sharp change at the same position among the plurality of histograms may be taken as the block grayscale threshold, or 1.2 times of the value may be taken as the block grayscale threshold. For another example, the block grayscale threshold may be directly determined according to the histograms of pixels of the background region in the display image, that is, the grayscale value of a pixel of the background region is taken as the block grayscale threshold.

Step S122: taking a display pixel, a grayscale value of which is less than the block grayscale threshold, as the background pixel.

Step S123: taking a display pixel, a grayscale value of which is greater than or equal to the block grayscale threshold, as the target pixel.

For example, in another example, in a case where the display image corresponding to one boundary backlight block includes the target pixel regions with various grayscales, as shown in FIG. 2B, the target pixel region A1, the target pixel region A2, and the background pixel region B with various grayscales, the above regions can be obtained by a regional analysis method based on the grayscale values of all display pixels corresponding to the boundary backlight block. The regional analysis method can be implemented by an algorithm, for example, by adopting a histogram analysis method, and the details are not described here. For example, as shown in FIG. 2B, three regions can be obtained according to the various grayscale values, that is, a first region corresponding to A1, a second region corresponding to A2, and a third region corresponding to B. For example, the average grayscale value of the display pixels in each region is obtained (for example, the average grayscale value can be obtained by dividing the sum of the grayscale values of the display pixels in each region by the number of display pixels in each region), and the region having the smallest average grayscale value is taken as the background region, and the display pixels in the background region are taken as the background pixels, and the display pixels in the display region other than the background region are taken as the target pixels, so the target pixels and the background pixels in each boundary backlight block can be determined.

It should be noted that in a case where the background of the display image is fully black (for example, the grayscale value of each background pixel is 0), the background pixels respectively corresponding to each boundary backlight block can be directly determined according to the grayscale value. For example, a display pixel, a grayscale value of which is 0, is taken as the background pixel directly.

After determining the target pixels and the background pixels corresponding to each boundary backlight block through the above steps S121-S123, the number N (N is an integer greater than 1) of target pixels and the number M (M is an integer greater than 1) of background pixels corresponding to each boundary backlight block are respectively counted. And the grayscale values of the target pixels corresponding to each boundary backlight block and the grayscale values of the background pixels corresponding to each boundary backlight block are respectively summed to obtain the average grayscale G1 of the target pixels corresponding to each boundary backlight block and the average grayscale G2 of the background pixels corresponding to each boundary backlight block. The backlight value of each boundary backlight block can be obtained based on the average grayscale G1 of the target pixels corresponding to each boundary backlight block and the average grayscale G2 of the background pixels corresponding to each boundary backlight block.

For example, the average grayscale of the target pixels corresponding to each boundary backlight block is expressed as:

$$G1 = \frac{\sum_{i=1}^{N} L_i}{N}$$

where $L_i$ represents a grayscale value of an i-th target pixel, $1 \le i \le N$, N is an integer greater than 1, and N represents the number of the target pixels corresponding to each boundary backlight block.

For example, the average grayscale of the background pixels corresponding to each boundary backlight block is expressed as:

$$G2 = \frac{\sum_{j=1}^{M} L_j}{M}$$

where $L_i$ represents a grayscale value of a j-th background pixel, $1 \le j \le M$, M is an integer greater than 1, and M represents the number of background pixels corresponding to each boundary backlight block.

For example, the backlight value of each boundary backlight block is expressed as:

$$G=G1*K+(1-K)*G2$$

where G represents the backlight value of each boundary backlight block, G1 represents the average grayscale of the target pixels corresponding to each boundary backlight block, G2 represents the average grayscale of the background pixels corresponding to each boundary backlight block, and K represents a ratio of the number of target pixels, corresponding to each boundary backlight block, to a total number of the display pixels, corresponding to each boundary backlight block.

For example, the ratio K of the number of the target pixels corresponding to each boundary backlight block to the total number of the display pixels corresponding to each boundary backlight block can be expressed as:

$$K=N/(M+N)$$

where N represents the number of the target pixels corresponding to each boundary backlight block, and M represents the number of the background pixels corresponding to each boundary backlight block.

For example, in a case where the display backlight block is the boundary backlight block, the ratio T is equal to the ratio K.

After the backlight value of the boundary backlight block is adjusted by the above method, the backlight value of each boundary backlight block is reduced according to a certain proportion, so the halo in the display image can be weakened.

It should be noted that the formula of the backlight value G of each boundary backlight block is not limited to the above formula, and also may be implemented by other methods that can reduce the backlight value to a proportion, and details are not described here again.

For example, a backlight value acquisition circuit may be provided, and the backlight values of the boundary backlight blocks are obtained by the backlight value acquisition circuit. The backlight values of the boundary backlight blocks may also be acquired by a central processing unit (CPU), a graphics processing unit (GPU), a field programmable logic gate array (FPGA), or other processing units with a data processing capabilities and/or instruction execution capabilities.

For example, after acquiring the backlight value G of the boundary backlight block, the image display processing method may further include: performing a process of smooth filtering on the plurality of display backlight blocks to adjust the backlight value of each boundary backlight blocks.

After reducing the backlight value of each boundary backlight block, a phenomenon that the brightness of the display image is different may be arisen because the decrease degree of the backlight value of the boundary backlight block is reduced too much. For example, the brightness difference can be overcome by performing the process of smooth filtering on the plurality of display backlight blocks to adjust the backlight value of each boundary backlight block. For example, the smoothing filtering can be implemented by Gaussian filtering or other methods in the art, and details are not described here again. However, due to visual characteristics of human eyes, even if there is a certain degree of brightness difference in the display image, the brightness difference may not be perceived by the human eyes.

The image display processing method of the embodiments of the present disclosure may further include compensating display data of the display image according to the adjusted backlight values of the boundary backlight blocks, and transmitting the compensated display data to the display panel of the display device to control the deflection of the liquid crystal to control the transmission degree of light of the backlight unit, and realizing corresponding display. Therefore, in order to avoid the brightness difference of the display image due to reason that the decrease degree of the backlight value of the boundary backlight block is reduced too large, the display data of the display image can also be controlled to overcome the above-described brightness difference. For example, the method of compensating the display data of the display image can be implemented by an algorithm in the art, and details are not described here again.

Because the above image display processing method is an operation of adjusting the backlight value of each boundary backlight block based on the display backlight blocks, the division mode of the display backlight blocks may have an influence on the desired effect (weakening the halo). For example, the number of the target pixels corresponding to one boundary backlight block, the average gray level G1 of the target pixels, the number of the background pixels, and the average gray level G2 of the background pixels may vary with the difference of the number of display backlight blocks. Thus, the number of display backlight blocks also affects the ratio K (related to the numbers of target pixels and background pixels). Therefore, according to the formula G=G1*K+(1-K)*G2, in a case where the number of display backlight blocks is different, the obtained adjusted backlight value G is also different. Therefore, from a perspective of weakening the halo, the number of display backlight blocks can be determined again (e.g., the display backlight blocks are re-divided in another mode), that is, when determining the number of display backlight blocks, from the perspective of the display effect, the number range of display backlight blocks with a better effect of weakening the halo is obtained.

Figure 6:
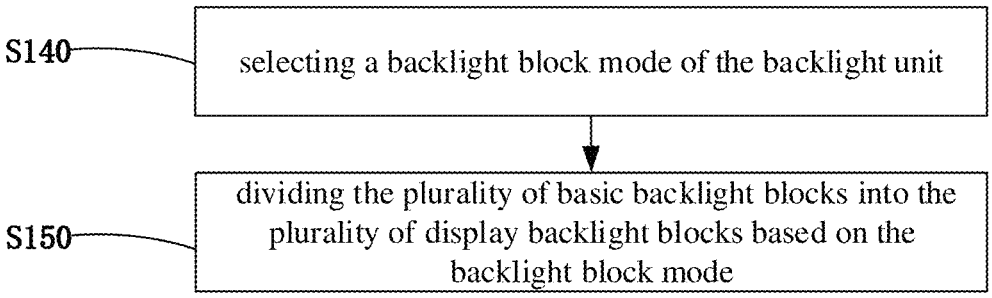
FIG. 6 is a flowchart of a method of dividing a display backlight block according to at least an embodiment of the present disclosure.

FIG. 6 is a flowchart of a method of dividing a display backlight block according to at least an embodiment of the present disclosure. For example, the backlight unit as shown in FIG. 1A includes a plurality of basic backlight blocks, and the image display processing method further includes re-dividing the display backlight block from the perspective of weakening the halo. For example, the basic backlight blocks may be a backlight unit that is not divided according to the method. As shown in FIG. 6, the method includes steps S140-S150.

Step S140: selecting a backlight block mode of the backlight unit.

The backlight block mode of the backlight unit may be determined based on power consumption of the backlight unit and/or a display effect (for example, weakening the halo) of the display image. For example, when dividing the display backlight block, the basic backlight block can be divided according to the number range, having the smallest power consumption of the backlight unit and the better effect of weakening the halo, of the display backlight blocks.

Step S150: dividing the plurality of basic backlight blocks into the plurality of display backlight blocks based on the backlight block mode.

For example, the basic backlight block can be divided into a plurality of display backlight blocks from the perspective of the power consumption of the backlight unit firstly. For example, when the number of display backlight blocks divided by the basic backlight block ranges from 400 to 900, the power consumption of the backlight unit may be minimized Also, the range of the number of display backlight blocks can be further reduced from the perspective of weakening the halo. For example, when the number of display backlight blocks is 400, after the backlight value of the boundary backlight block is adjusted by the image display processing method described above, the halo of the display image displayed by the display pixels corresponding to the boundary backlight block is still relatively obvious; when the number of display backlight blocks is increased to 600, after the backlight value of the boundary backlight block is adjusted by the image display processing method described above, the halo of the display image displayed by the display pixels corresponding to the boundary backlight block is significantly weakened, so the number range of display backlight blocks can be selected to be between 600-900.

The display backlight blocks obtained by the above steps S140 and S150 can further weaken the halo in the display image.

For example, the above steps S140 and S150 may be realized by a central processing unit (CPU), an image processor (GPU), a field programmable logic gate array (FPGA), or other processing units with a data processing capabilities and/or instruction execution capabilities.

In the step S130, the backlight value of each non-boundary backlight block in the display backlight blocks is a maximum value of grayscale values of all display pixels corresponding to each non-boundary backlight block, and may also be a value between 0.85-1.00 times of the maximum value. The backlight value may be determined according to specific conditions, and embodiments of the present disclosure have no limit in this aspect. It should be noted that the average value of the grayscale values of the display pixels corresponding to the non-boundary backlight block may also be taken as the backlight value. For example, the maximum value or the average value of the grayscale values of all display pixels corresponding to the non-boundary backlight block can be obtained by any method in the art, and details are not described here again. For example, the grayscale values of all display pixels corresponding to each non-boundary backlight block are the grayscale values obtained after the display image is processed by the data decoding circuit and gamma correction.

For example, the backlight values of the boundary backlight blocks and the backlight values of the non-boundary backlight blocks are transmitted to the MCU 131 in the LED driving circuit board 13 as shown in FIG. 1B to drive LEDs to emit light in the corresponding display backlight blocks in the backlight unit; also, the compensated display data are transmitted to the data driving circuit of the display panel, and the display panel is located in front of the backlight unit. For example, liquid crystal molecules in sub-pixels of the liquid crystal panel located in front of the backlight unit are correspondingly deflected according to the compensated display data input by the data driving circuit, so the degree of transmission (i.e., the transmittance) of the polarized light after the light of each backlight block of the LED backlight unit is transmitted through the polarizing plate is controlled, thereby displaying the corresponding grayscales of the sub-pixels on the display screen, thereby realizing display of the display image.

For example, an image display circuit can be provided, and the display of the display image can be realized by the image display circuit, and may also be realized by a central processing unit (CPU), an image processor (GPU), a field programmable logic gate array (FPGA), or other processing units with a data processing capabilities and/or instruction execution capabilities.

For example, the various parameters of the plurality of operation steps such as the preset threshold T, the backlight value G of each boundary backlight block, the average gray level G1 of the target pixels corresponding to each boundary backlight block, the average gray level G2 of the background pixels corresponding to each boundary backlight block, the ratio K of the number of the target pixels corresponding to each boundary backlight block to the total number of the display pixels, and the like, may be stored in a storage of the display panel, and invoked by a controller (e.g., an FPGA) as needed. It should be noted that the following embodiments are the same as the above described, and are not described again.

It should be noted that, in some embodiments of the present disclosure, the flow of the image display processing method may include more or less operations, and these operations can be performed sequentially or in parallel. Although the flow of the image display processing method described above includes a plurality of operations in a specific order, it should be clearly understood that the order of the plurality of operations is not limited. The image processing method described above may be performed once or may be performed a plurality of times according to predetermined conditions.

The image display processing method provided by the above embodiments of the present disclosure reduces the backlight value of the boundary backlight block according to a certain proportion to achieve the effect of weakening the halo, so the problem of the halo generated in the display image displayed on the display panel in a case where the local dimming technology is performed to drive the backlight block can be solved or alleviated, and the display quality of the display panel can be improved.

Figure 7:
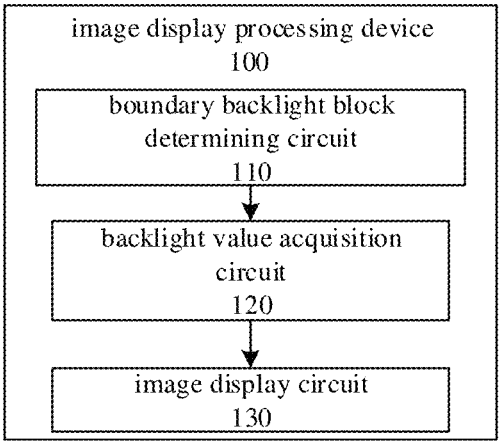
FIG. 7 is a schematic block diagram of an image display processing device according to at least an embodiment of the present disclosure.

FIG. 7 is a schematic block diagram of an image display processing device according to at least an embodiment of the present disclosure. As shown in FIG. 7, the image display processing device 100 includes a boundary backlight block determining circuit 110, a backlight value acquisition circuit 120, and an image display circuit 130.

The boundary backlight block determining circuit 110 is configured to determine at least one boundary backlight block corresponding to a display image in a plurality of display backlight blocks (or out of the plurality of display backlight blocks). For example, the boundary backlight block determining circuit 110 may implement the step S110, and the specific implementation of the boundary backlight block determining circuit 110 can refer to the above related description of the step S110, and details are not described here again.

The backlight value acquisition circuit 120 is configured to determine at least one target pixel and at least one background pixel respectively corresponding to each boundary backlight block, and obtain a backlight value of each boundary backlight block based on a grayscale value of the at least one target pixel and a grayscale value of the at least one background pixel. For example, the backlight value acquisition circuit 120 may implement the step S120, and the specific implementation of the backlight value acquisition circuit 120 can refer to the above related description of the step S120, and details are not described here again.

The image display circuit 130 is configured to display the display image based on the backlight value of each boundary backlight block corresponding to the display image and a backlight value of at least one non-boundary backlight block other than the at least one boundary backlight block in the plurality of display backlight blocks. For example, the image display circuit 130 may implement the step S130, and the specific implementation of the image display circuit 130 can refer to the above related description of the step S130, and details are not described here again.

It should be noted that the image display processing device provided in the embodiments of the present disclosure may include more or less circuits, and the connection relationship among the circuits is not limited, and may be determined according to actual requirements. No limitation is imposed to the specific structure of each circuit, the circuit can include an analog component according to a principle of the circuit, or a digital chip, or other appropriate devices or components.

Figure 8:
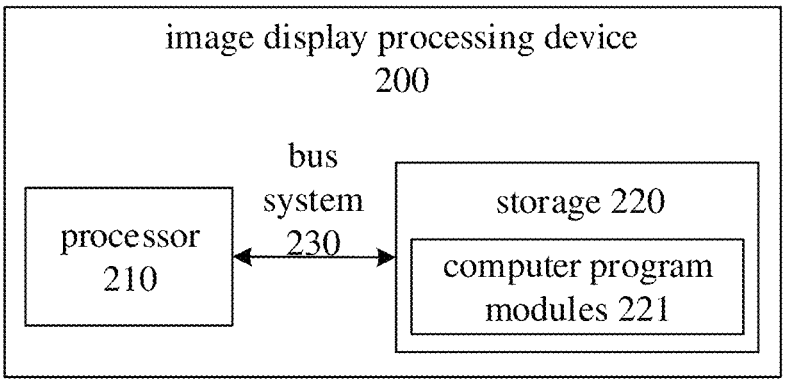
FIG. 8 is a schematic block diagram of another image display processing device according to at least an embodiment of the present disclosure.

FIG. 8 is a schematic block diagram of another image processing device according to at least an embodiment of the present disclosure. As shown in FIG. 8, the image display processing device 200 includes a processor 210, a storage (memory) 220, and one or a plurality of computer program modules 221.

For example, the processor 210 is connected with the storage 220 by a bus system 230. For example, the one or more computer program modules 221 are stored in the storage 220. For example, the one or more computer program modules 221 include one or more instructions that are executable by a computer used for achieving the image display processing method provided by any one of the embodiments of the present disclosure. For example, the instructions of the one or the plurality of computer program modules 221 can be executed by the processor 210. For example, the bus system 230 is a serial or parallel communication bus, etc., and no limitation is imposed in this aspect in the embodiments of the present disclosure.

For example, the processor 210 may be a central processing unit (CPU), a graphics processing unit (GPU), or other processing units with a data processing ability and/or instruction execution ability. For example, the processor 210 may be a general processor or a dedicated processor, and can control other components in the image processing device 200 to achieve the expected functions.

For example, the storage 220 can include one or more computer program products, and the computer program products includes a computer-readable storage media in various forms. For example, the storage 220 is a volatile storage and/or a non-volatile storage. The volatile storage, for example, includes a random access memory (RAM) and/or a cache memory, etc. The non-volatile storage, for example, includes a read-only memory (ROM), a hard disk, and a flash memory, etc. One or more computer program instructions can be stored in the computer-readable storage medium, and the processor 210 can run or execute the program instructions to realize the functions (which are to be realized by the processor 210) in the embodiments of the present disclosure and/or other expected functions, such as an image display processing method, etc. Various applications and data, such as a preset threshold and backlight value used and/or generated by application programs, etc., can also be stored in the computer-readable storage medium.

It should be noted that in order to be clear and concise, the present embodiment of the disclosure does not illustrate all components of the image display processing device 200. Those skilled in the art can provide and arrange other components, which are not illustrated in the figures, of the image display processing device 200 according to actual requirements to achieve necessary functions of the image display processing device 200.

Technical effects of the image display processing device 100 and the image display processing device 200 in different embodiments can be referred to the technical effects of the image display processing method provided by at least one embodiment of the present disclosure, and details are not described here again.

Figure 9:
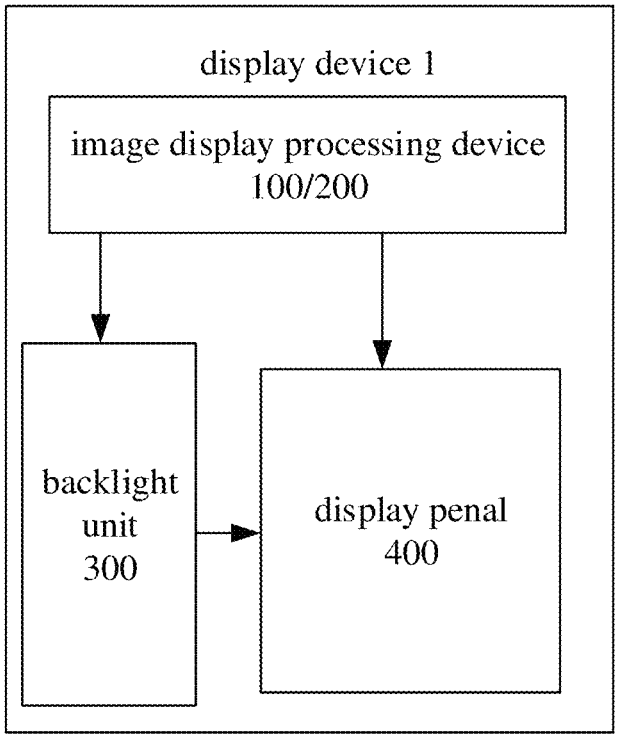
FIG. 9 is a schematic diagram of a display device according to at least an embodiment of the present disclosure.

Some embodiments of the present disclosure also provide a display device 1. The display device 1 may include an image display processing device provided by any of the embodiments of the present disclosure. For example, the display device 1 includes the image display processing device 100 as shown in FIG. 7 or the image display processing device 200 as shown in FIG. 8. For example, the image display processing device 100/200 can weaken the halo problem generated in the display image of the display panel in a case where the local dimming technology is performed to drive the display backlight block, and improve the display quality of the display panel. FIG. 9 is a schematic structural diagram of a display device 1 according to at least an embodiment of the present disclosure. As shown in FIG. 9, the display device 1 includes an image display processing device 100/200, a backlight unit 300, and a display panel 400. For example, the backlight unit 300 can be divided into a plurality of display backlight blocks and driven by a local dimming mode.

For example, the image display processing device 100/200 acquires the backlight values of the non-boundary backlight blocks, the adjusted backlight values of the boundary backlight blocks, and the compensated display data. The backlight values of the non-boundary backlight blocks and the adjusted backlight values of the boundary backlight blocks are transmitted to, for example, the LED driving circuit board 13 in the backlight unit 300 (as shown in FIG. 1B), thereby controlling the LEDs in the corresponding display backlight block of the backlight unit to emit light. Also, the compensated display data is transmitted to, for example, a driving chip (not shown in the figures, for example, a data driving circuit) in the display panel 400 to control the deflection of the liquid crystal molecules of the liquid crystal layer in the display panel to enable the light emitted from the backlight unit to pass though the liquid crystal layer, thereby displaying the display image on the display panel 400.

For example, the display device 1 may be a thin film transistor liquid crystal display device, an electronic paper display device, or the like. For example, the display device is a VR device, such as a VR helmet or the like, and the embodiments of the present disclosure are not limited to this case.

For example, the units are interconnected by a bus system and/or other coupling mechanisms (not shown in figures). For example, the bus system may be a conventional serial, parallel communication bus, etc., and the embodiments of the present disclosure do not limit to this case.

It should be noted that the components and structures of the display device 1 as shown in FIG. 9 are merely exemplary and not limiting, and the display device 1 may have other components and structures as needed.

It should be noted that in order to be clear and concise, the present embodiment of the disclosure does not illustrate all components of the display device 1. Those skilled in the art can provide and arrange other components, which are not illustrated in the figures, of the display device 1 according to actual requirements to achieve necessary functions of the display device 1.

Technical effects of the display device 1 can be referred to the technical effects of the image display processing method for a display device provided by the embodiments of the present disclosure, and details are not described here again.

Some embodiments of the present disclosure also provide a non-volatile storage medium. For example, the non-volatile storage medium can store a computer-readable instruction non-transitorily, and in a case where the computer-readable instruction stored non-transitorily is executed by a computer (including a processor), the image display processing method provided by any one of the embodiments of the present disclosure may be executed.

For example, the non-volatile storage medium is any combination of one or more computer-readable storage media. For example, one computer-readable storage medium includes computer-readable program codes used for determining the boundary backlight block, and another computer-readable storage medium includes computer-readable program codes used for obtaining the backlight values of the boundary backlight blocks. For example, in a case where the program code is read by the computer, the program code stored in the computer-readable storage medium is executed by the computer, and for example, the image display processing method provided by any one of the embodiments of the present disclosure is executed.

For example, the storage media may include a memory card of a smart phone, a storage component of a tablet, a hard disk of a personal computer, a random access memory (RAM), a read-only memory (ROM), a erasable programmable read-only memory (EPROM), a portable compact disk read-only memory (CD-ROM), a flash memory, or any combination of the above-mentioned storage media, or other suitable storage media.

The following should be noted:

(1) Only the structures involved in the embodiments of the present disclosure are illustrated in the drawings of the embodiments of the present disclosure, and other structures can refer to usual designs.

(2) The embodiments and features in the embodiments of the present disclosure may be combined in case of no conflict to obtain new embodiments.

The foregoing merely are exemplary embodiments of the disclosure, and not intended to define the scope of the disclosure, and the scope of the disclosure is determined by the appended claims.

What is claimed is:

1. An image display processing method for a display device, the display device comprising a backlight unit, the backlight unit being divided into a plurality of display backlight blocks and driven by a local dimming mode, and the image display processing method comprising:

determining at least one boundary backlight block corresponding to a display image in the plurality of display backlight blocks;

determining at least one target pixel and at least one background pixel corresponding to each boundary backlight block, and obtaining a backlight value of each boundary backlight block based on a grayscale value of the at least one target pixel and a grayscale value of the at least one background pixel; and displaying the display image based on the backlight value of each boundary backlight block corresponding to the display image and a backlight value of at least one non-boundary backlight block other than the at least one boundary backlight block in the plurality of display backlight blocks, wherein the backlight value of each boundary backlight block is expressed as:

$$G=G1*K+(1-K)*G2$$

where G represents the backlight value of each boundary backlight block, G1 represents an average grayscale of the at least one target pixel corresponding to each boundary backlight block, G2 represents an average grayscale of the at least one background pixel corresponding to each boundary backlight block, and K represents a ratio of a number of target pixels corresponding to each boundary backlight block to a total number of display pixels corresponding to each boundary backlight block.

2. The image display processing method according to claim 1, wherein the average grayscale of the at least one target pixel corresponding to each boundary backlight block is expressed as:

$$G1 = \frac{\sum_{i=1}^{N} L_i}{N}$$

where $L_i$, represents a grayscale value of an i-th target pixel, $1 \le i \le N$, N is an integer greater than 1, and N represents the number of the target pixels corresponding to each boundary backlight block.

3. The image display processing method according to claim 1, wherein the average grayscale of the at least one background pixel corresponding to each boundary backlight block is expressed as:

$$G2 = \frac{\sum_{j=1}^{M} L_j}{M}$$

where $L_j$ represents a grayscale value of a j-th background pixel, $1 \le j \le M$, M is an integer greater than 1, and M represents a number of background pixels corresponding to each boundary backlight block.

4. The image display processing method according to claim 1, wherein determining the at least one boundary backlight block corresponding to the display image in the plurality of display backlight blocks comprises:

setting a preset threshold;

obtaining a ratio of a number of target pixels, corresponding to each of the plurality of display backlight blocks corresponding to the display image, to a total number of display pixels, corresponding to each of the plurality of display backlight blocks, respectively;

judging whether the ratio of the number of the target pixels, corresponding to each of the plurality of display backlight blocks, to the total number of the display pixels, corresponding to each of the plurality of display backlight blocks, is less than or equal to the preset threshold respectively; and taking a display backlight block having a ratio less than or equal to the preset threshold as the boundary backlight block.

5. The image display processing method according to claim 1, wherein determining the at least one boundary backlight block corresponding to the display image in the plurality of display backlight blocks comprises:

obtaining a pattern analysis result of the display image, wherein the pattern analysis result records a boundary pixel; and taking a display backlight block corresponding to the boundary pixel as the boundary backlight block.

6. The image display processing method according to claim 1, further comprising:

selecting a block grayscale threshold of all display pixels corresponding to each of the plurality of display backlight blocks;

taking a display pixel, a grayscale value of which is less than the block grayscale threshold, as the background pixel; and taking a display pixel, a grayscale value of which is greater than or equal to the block grayscale threshold, as the target pixel.

7. The image display processing method of claim 1, wherein the backlight unit comprises a plurality of basic backlight blocks, and the image display processing method further comprises:

selecting a backlight block mode of the backlight unit, and dividing the plurality of basic backlight blocks into the plurality of display backlight blocks based on the backlight block mode.

8. The image display processing method according to claim 7, wherein the backlight block mode of the backlight unit is determined based on power consumption of the backlight unit and/or a display effect of the display image.

9. The image display processing method according to claim 1, further comprising:

after acquiring the backlight value of each boundary backlight block, performing a process of smooth filtering on the plurality of display backlight blocks to adjust the backlight value of each boundary backlight blocks.

10. The image display processing method according to claim 1, wherein the backlight value of each non-boundary backlight block is a maximum value of grayscale values of all display pixels corresponding to each non-boundary backlight block.

11. A non-volatile storage medium, storing a computer-readable instruction non-transitorily, and executing an instruction of the image display processing method according to claim 1 in a case where the computer-readable instruction stored non-transitorily is executed by a computer.

12. An image display processing device, comprising:

a boundary backlight block determining circuit, configured to determine at least one boundary backlight block corresponding to a display image in a plurality of display backlight blocks:

a backlight value acquisition circuit, configured to determine at least one target pixel and at least one background pixel respectively corresponding to each boundary backlight block, and obtain a backlight value of each boundary backlight block based on a grayscale value of the at least one target pixel and a grayscale value of the at least one background pixel; and an image display circuit, configured to display the display image based on the backlight value of each boundary backlight block corresponding to the display image and a backlight value of at least one non-boundary backlight block other than the at least one boundary backlight block of the plurality in display backlight blocks, wherein the backlight value of each boundary backlight block is expressed as:

$$G = G1 * K + (1 - K) * G2$$

where G represents the backlight value of each boundary backlight block, G1 represents an average grayscale of the at least one target pixel corresponding to each boundary backlight block, G2 represents an average grayscale of the at least one background pixel corresponding to each boundary backlight block, and K represents a ratio of a number of target pixels corresponding to each boundary backlight block to a total number of display pixels corresponding to each boundary backlight block.

13. The image display processing device according to claim 12, wherein the average grayscale of the at least one target pixel corresponding to each boundary backlight block is expressed as:

$$G1 = \frac{\sum_{i=1}^{N} L_i}{N}$$

where $L_i$, represents a grayscale value of an i-th target pixel, $1 \leq i \leq N$, N is an integer greater than 1, and N represents the number of the target pixels corresponding to each boundary backlight block.

14. The image display processing device according to claim 12, wherein the average grayscale of the at least one background pixel corresponding to each boundary backlight block is expressed as:

$$G2 = \frac{\sum_{j=1}^{M} L_j}{M}$$

where $L_j$ represents a grayscale value of a j-th background pixel, $1 \leq j \leq M$, M is an integer greater than 1, and M represents the number of background pixels corresponding to each boundary backlight block.

15. An image display processing device, comprising:

a processor;

a storage; and one or a plurality of computer program modules, wherein the one or the plurality of computer program modules are stored in the storage and are configured to be executed by the processor, and the one or the plurality of computer program modules comprise an instruction used for achieving the image display processing method according to claim 1.

16. A display device, comprising a backlight unit and the image display processing device according to claim 12.

17. A display device, comprising a backlight unit and the image display processing device according to claim 15.

* * * * *